United States Patent [19]

Hamai et al.

[11] Patent Number: 4,497,306

[45] Date of Patent: Feb. 5, 1985

[54] IGNITION SYSTEM FOR AN INTERNAL COMBUSTION ENGINE

[75] Inventors: Kyugo Hamai, Yokosuka; Yasuhiko Nakagawa, Kamakura; Meroji Nakai, Yokosuka; Ryusaburo Inoue, Yokohama, all of Japan

[73] Assignee: Nissan Motor Company, Limited, Yokohama, Japan

[21] Appl. No.: 403,858

[22] Filed: Jul. 30, 1982

[30] Foreign Application Priority Data

Aug. 3, 1981 [JP] Japan ..... 56-120652

[51] Int. Cl.[3] ..... F02D 3/08

[52] U.S. Cl. ..... 123/620; 123/643

[58] Field of Search ..... 123/416, 417, 425, 620, 123/621, 622, 643, 644

[56] References Cited

U.S. PATENT DOCUMENTS

| | | | |
|---|---|---|---|
| 2,975,331 | 3/1961 | Diaz et al. . | |
| 3,334,270 | 8/1967 | Nuckolls . | |
| 3,716,038 | 2/1973 | Bevacqua | 123/635 X |
| 3,874,349 | 4/1975 | Fitzner . | |
| 4,033,316 | 7/1977 | Birchenough . | |
| 4,136,301 | 1/1979 | Shimojo et al. . | |
| 4,170,207 | 10/1979 | Boyama . | |
| 4,194,480 | 3/1980 | Rado . | |
| 4,208,992 | 6/1980 | Polo . | |
| 4,292,569 | 9/1981 | Gerry | 123/620 X |
| 4,365,186 | 12/1982 | Gerry | 123/620 X |
| 4,367,531 | 1/1983 | Furuhashi et al. | 123/425 X |
| 4,369,757 | 1/1983 | Anzai | 123/620 |

FOREIGN PATENT DOCUMENTS

| | | | |
|---|---|---|---|
| 23998 | 2/1981 | European Pat. Off. | 123/620 |
| 1529364 | 10/1978 | United Kingdom . | |
| 2023725 | 1/1980 | United Kingdom . | |

*Primary Examiner*—Tony M. Argenbright

*Attorney, Agent, or Firm*—Schwartz, Jeffery, Schwaab, Mack, Blumenthal & Koch

[57] ABSTRACT

An ignition system for an internal combustion engine having a plurality of engine cylinders, wherein ignition coil and spark plug are integrally assembled into each engine cylinder so as to eliminate an ignition energy transmission loss, a DC-DC converter for boosting a low DC voltage into a high DC voltage is provided for applying the high DC voltage into each secondary winding of the ignition coils for achieving an efficient ignition of air-fuel mixture, the application of the high DC voltage being enabled according to a particular engine operating condition, e.g., engine low speed and light engine load condition, and the ignition energy being varied according to an engine operating condition by changing the pulsewidth of the ignition pulse signal to be fed into a cylinder judging circuit which judges the spark plug to be ignited and distributes the ignition pulse signal into the related circuit of the corresponding ignition coil.

8 Claims, 9 Drawing Figures

TO DC VOLTAGE SUPPLY 1 (BATTERY)
MONOSTABLE MULTIVIBRATOR
6a2
AMPLIFIER
6a3
TO DC VOLTAGE SUPPLY 1 (BATTERY)
FROM 14 OF FIG.2(A) OR FIG.3(A)
TRIGGER SIGNAL GENERATOR
6a1
FROM DC/DC CONVERTER(17)
6a
6b
7
10
13
16
L1
L2
R1
R2
R3
R4
R5
R6
R7
R8
R9
R10
R11
R12
R13
R14
R15
R16
R17
R18
R19
R20
R0
C1
C2
D9
D10
D11
Q1
Q2
Q3
Q4
Q5
Q6
Q7
Q8

IGNITION SYSTEM FOR AN INTERNAL COMBUSTION ENGINE

BACKGROUND OF THE INVENTION

1. Field of the Invention

The present invention relates generally to an ignition system for an internal combustion engine, and more specifically to an ignition system for an internal combustion engine, wherein an ignition coil and spark plug are integrally incorporated into each engine cylinder to eliminate ignition energy loss caused by conventional high-tension cables and a DC-DC converter for boosting DC voltage is connected to the secondary winding of each ignition coil so as to operatively apply a high DC voltage across each spark plug so as to extend the discharge duration of each spark plug under such an engine operating condition as a low engine speed (engine start, idling speed, etc.) and light engine load conditions.

2. Description of the Prior Art

A conventional ignition system for an internal combustion engine includes:

(a) a low DC voltage bias supply such as a vehicle battery;

(b) an ignition signal detector biased from the low DC voltage bias supply for detecting and outputting an ignition reference signal;

(c) an ignitor for intermittently firing spark plugs;

(d) an ignition coil connected to the ignitor at the primary winding thereof and to the DC bias supply at a center tap of the primary winding; and (e) a plurality of diodes, each connected between a corresponding plug and either end of the secondary winding of the ignition coil so as to form a current circuit with other plug(s) at an opposite end of the secondary winding. The ignitor comprises: (a) an spark advance angle controller connected to the ignition signal detector for controlling the spark timing of the spark plugs related to the ignition reference signal; (b) a pair of primary current controllers connected to the spark advance angle controller; and (c) a pair of power transistors, the base of each being connected to the corresponding primary current controller, the emitter of each being grounded, and the collector of each being connected to the corresponding end of the primary winding of the ignition coil. Each primary current controller controls the turning-on interval and timing of the corresponding power transistor according to the output signals from the advance angle controller so that the primary winding of the ignition coil provides a current flow of opposite directions.

In such a conventional system of the construction described above, the primary winding of the ignition coil provides an alternating current flow so that the secondary winding thereof produces a multiplied high AC voltage. The AC voltage generates the spark discharge twice within one engine cycle at each spark plug, i.e., first in the compression stroke and second in the exhaust stroke. The ignition system described hereinabove is a "Haltig" ignition system. In such ignition system, there is an advantage that the efficiency of ignition energy is enhanced with the elimination of transmission energy loss, since there is no conventional mechanical distributor and central cord associated with the distributor.

However, since the conventional ignition system ignites twice during each engine cycle for each engine cylinder, it loses the effect of eliminating the mechanical distributor and avoiding large power consumption from the vehicle battery as the low DC bias supply and wasteful fuel consumption accordingly results. The weight of the ignition coil is increased so that a wider space is required. Furthermore, it is difficult to improve the combustion performance by increasing or decreasing the ignition energy according to various engine operating condition since the polarity of electrodes of the spark plugs is continuously reversed.

SUMMARY OF THE INVENTION

With the above-described problems in mind, it is an object of the present invention to provide an ignition system for a multi-cylinder internal combustion engine, wherein a cylinder judging circuit, provided at a primary winding of an ignition coil discriminates the spark plugs to be ignited according to a predetermined ignition order in response to a pulse signal representative of an engine cycle so that one ignition is carried out within each engine cycle for each of the engine cylinders, and wherein an ignition coil is integrally assembled with a corresponding spark plug into each engine cylinder for eliminating the wasteful consumption of ignition energy due to a high-tension cable conventionally provided between the ignition coil and corresponding spark plug, and wherein the ignition energy is varied according to engine operating conditions by changing the output timing of the ignition pulse signal to be fed into the cylinder judging circuit and by applying a high DC voltage across the secondary winding and corresponding spark plug.

BRIEF DESCRIPTION OF THE DRAWINGS

The features and advantages of the engine ignition system according to the present invention will be appreciated from the following description taken in the attached drawings in which like reference numerals designate corresponding elements, and in which.

DETAILED DESCRIPTION OF THE PREFERRED EMBODIMENTS

Reference will be made hereinafter to the attached drawings in order to facilitate understanding of the present invention.

Figure 1:
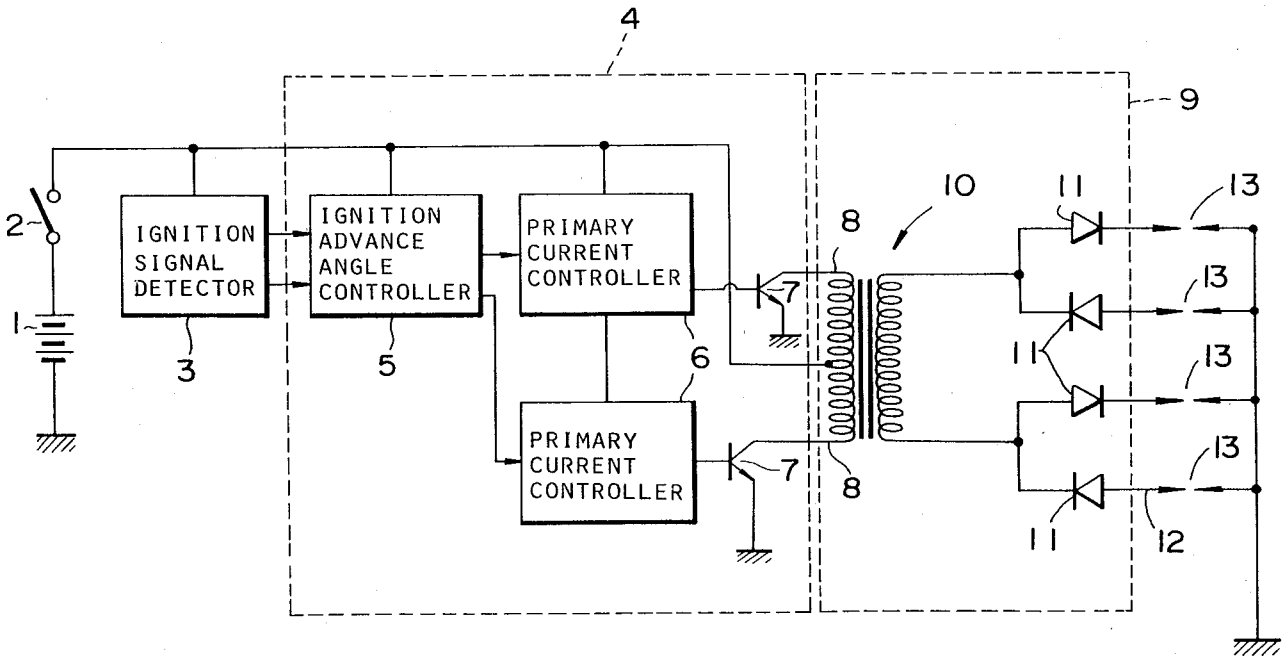
FIG.1 PRIOR ART
FIG. 1 is a simplified circuit diagram of a conventional ignition system for an internal combustion engine (so called "Haltig" system)

First FIG. 1 shows a conventional "Haltig" ignition system used for a four-cylinder internal combustion engine.

In FIG. 1, numeral 1 denotes a low DC voltage bias supply such as a vehicle battery. Numeral 2 denotes an ignition switch. Numeral 3 denotes an ignition signal detector, e.g., crank angle detector which produces a first pulse signal, i.e., 720° signal whenever the engine revolves two revolutions, i.e., the engine revolves one engine cycle. It should be noted that the ignition signal detector 3 produces a second pulse signal whenever the engine revolves through an angle predetermined by the number of engine cylinders, e.g., 180° in the case of four-cylinder engine. Numeral 4 denotes an ignitor. The internal construction of the ignitor 4 is described hereinafter. Numeral 9 denotes an ignition coil section having an ignition coil 10 and plurality of diodes 11. Both ends 8 of a primary winding of the ignition coil 10 are connected to the ignitor 4. Both ends of a secondary winding of the ignition coil 10 are connected to a plurality of spark plugs 13 within the engine cylinders via the diodes 11 having high reverse voltage withstanding characteristics so as to form a current circuit of a couple of the spark plugs 13. One electrode of each spark plug 13 is bundled and grounded and the other electrode of two spark plugs 13 is connected to either end of the secondary winding of the ignition coil 10. The connection between the secondary winding of the ignition coil 10 and each diode 11 is made with a high-tension cable. An intermediate tap of the primary winding of the ignition coil 10 is connected to the battery 1 via the ignition switch 2. The ignitor 4 comprises: (a) an ignition advance angle controller 5 which controls the actual ignition timing of the spark plugs 13 on a basis of the piston stroke position of each engine cylinder related to a top dead center; (b) a pair of primary winding current flow-angle controllers 6, each connected to the ignition advance angle controller 5 for controlling the current flow through the primary winding of the ignition coil 10 and limiting the peak value of the primary current; and (c) a pair of power transistors 7, each collector being connected to the corresponding end of the primary winding of the ignition coil 10, each emitter being grounded, and each base being connected to the corresponding primary current controller 6 so that the conduct interval of time of both power transistors 7 is controlled by the pair of primary current flow-angle controllers 6.

In the conventional ignition system shown in FIG. 1, a current that flows in opposite directions is produced at the primary winding of the ignition coil 10 with the intermediate tap as a center whenever the pair of power transistors 7 are alternatingly turned on. Furthermore, the spark plug 13 within each engine cylinder sparks twice during an interval of one engine cycle, i.e., during both compression and exhaust strokes.

Figure 2A:
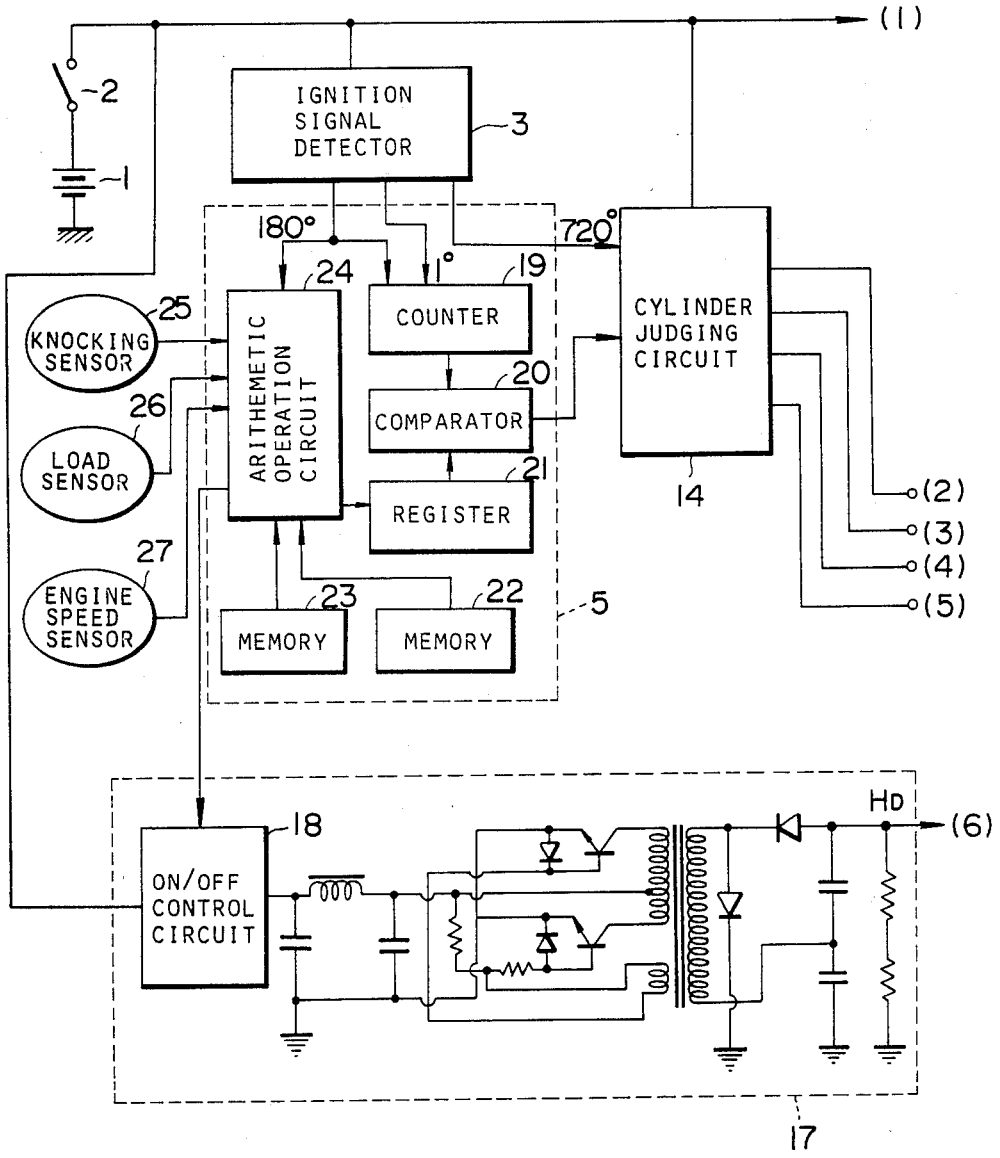
FIGS. 2(A) and 2(B) are simplified circuit diagrams of an ignition system for an internal combustion engine showing a first preferred embodiment according to the present invention.
Figure 2B:
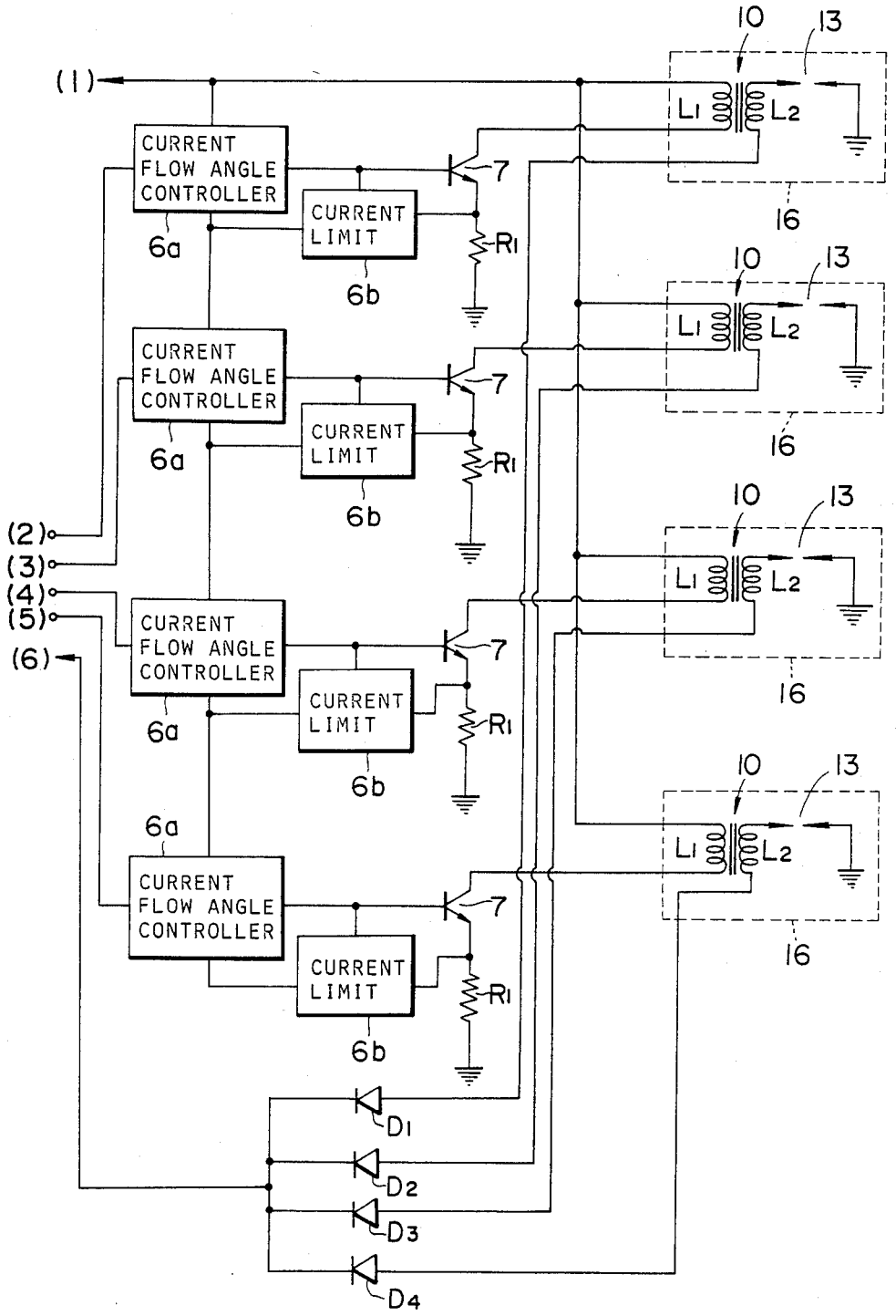

FIGS. 2(A) and 2(B) show in combination a first preferred embodiment of the present invention, particularly applied to the four-cylinder engine.

In this embodiment, the ignition coil 10 is of a closed magnetic circuit type having a high energy conversion efficiency and is built in an insulating housing 16 together with the corresponding spark plug 13 to assemble the ignition coils 10 and spark plugs 13 in pairs which are respectively attached to each engine cylinder. In addition, each central electrode of the spark plugs 13 is connected to one end of the corresponding secondary winding $L_2$ with corresponding side electrode thereof being grounded. The other end of each secondary winding $L_2$ thereof is connected to an output terminal HD of an DC-DC converter 17 via one of diodes $D_1$ through $D_4$. The DC-DC converter 17 is provided for boosting a low DC voltage e.g., 12 volts into a high DC voltage, e.g., in a range from 1000 up to 2000 volts. The high DC voltage is operatively applied across the respective spark plugs 13 via the corresponding secondary windings $L_2$ of the ignition coils 10 (in this embodiment, a negatively high DC voltage having an absolute value in the range described above is applied across each ignition coil 13 and secondary winding $L_2$ via the corresponding diode $D_1$ through $D_4$ as seen from FIGS. 2(A) and 2(B)) for maintaining a continuous discharge within the respective spark plugs 13 in response to the interruption of the primary current to be described hereinbelow. In addition, an on/off controller 18 is provided at the front stage of the DC-DC converter 17 which turns on in response to an output signal from an ignition advance angle control unit 5 to be described hereinbelow so as to actuate the DC-DC converter 17 depending on a particular engine operating condition.

One end of the primary windings $L_1$ are connected to a plus electrode of the battery 1 via the ignition switch 2 and the other ends thereof are connected to the collectors of each power transistor 7. The ignition advance angle control unit 5 comprises: (a) a counter 19; (b) comparator 20; (c) register 21; (d) memories 22 and 23; and (e) arithmetic operation circuit 24. The ignition signal detector 3 produces a third pulse signal whose pulsewidth corresponds to 1° (one degree) of revolutional angle of the engine (engine crankshaft), a second pulse signal whose period corresponds to 180° of revolutional angle of the engine (engine crankshaft), and a first pulse signal whose period corresponds to 720° (two revolutions) of the (crankshaft). The ignition advance angle control unit 5 receives the third and second pulse signals in such a way that the arithmetic operation circuit 24 and counter 19 receive the second pulse signal as a reset signal. At this time, the arithmetic operation circuit 24 accepts output signals from a knocking sensor 25 indicating the presence of engine knocking, an engine load sensor 26 indicating engine load e.g., from an fuel intake quantity, and an engine speed sensor 27 indicating the current engine speed and reads stored data within the memories 22 and 23 so as to perform the calculation of ignition advance angle with respect to a top dead center (TDC) of each piston. The calculated result is temporarily stored in the register 21. Thereafter, when the count value of the third pulse signal indicated by the counter 19 agrees with the contents (ignition advance angle data) of the register 21, the comparator 20 outputs the ignition pulse signal into a cylinder judging circuit 14 comprising, e.g., a four-bit ring counter (the bit number corresponds to the number of engine cylinders).

The cylinder judging circuit 14 designates the engine cylinder which is to be ignited in response to the first pulse (720°) signal from the ignition signal detector 3 so as to circularly distribute an ignition start signal, each having a pulsewidth corresponding to a 180° revolutional angle based on the ignition pulse signal from the comparator 20, into the designated engine cylinder via a primary current flow-angle controller **6*a* and a corresponding power transistor 7. The ignition start signal is outputted at a timing when the ignition pulse signal is received from the comparator 20 into the current flow-angle controller 6*a* and current limiting circuit 6*b*. The corresponding power transistor 7 then changes its conductivity so that the primary current of the corresponding ignition coil 10 is controlled and a counter electromotive force is generated and a high surge voltage is generated at a secondary winding $L_2$ of the corresponding ignition coil 10. The function of the current flow-angle controllers 6a and current limiters 6b correspond to the primary current controller 6 shown in FIG. 1**.

Furthermore, the arithmetic operation circuit 24 outputs a start command signal into the on/off control circuit 18 to enable the current flow from the low DC voltage supply (battery) 1 to the DC-DC converter 17 so that the DC-DC converter 17 is actuated to produce the high DC voltage. The on/off control circuit 18 comprise, e.g., an analog switch. The start command signal is outputted when the arithmetic operation circuit 24 determines, from the output signals of the load sensor 26, engine speed sensor 27 and an output signal representative of an engine cooling water temperature from an engine cooling water temperature sensor (not shown in the drawings), that the engine is revolving at a low speed during an engine cold start or engine idling condition or is operating under a low engine load condition by means of a look-up table technique using the memory 23.

Therefore, the DC-DC converter 17 produces the high DC voltage at the output terminal HD to apply the negatively high DC voltage to the secondary windings $L_2$ and spark plugs 13 only when the engine revolves at a low speed or under a light engine load condition. Consequently, a discharge duration of each spark plug 13 is extended by the application of the high DC voltage under such engine operating conditions as described above so that the ignition energy is accordingly increased.

Figure 5A:
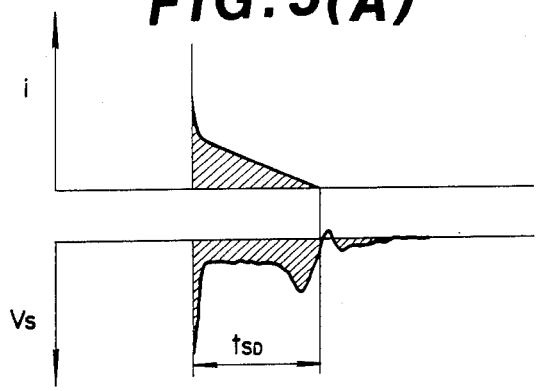
FIGS. 5(A), 5(B), and 5(C) are characteristic graphs showing discharge patterns of the ignition system of first and second preferred embodiments respectively shown in FIGS. 2(A) and 2(B) and in FIGS. 3(A) and 3(B).
Figure 5B:
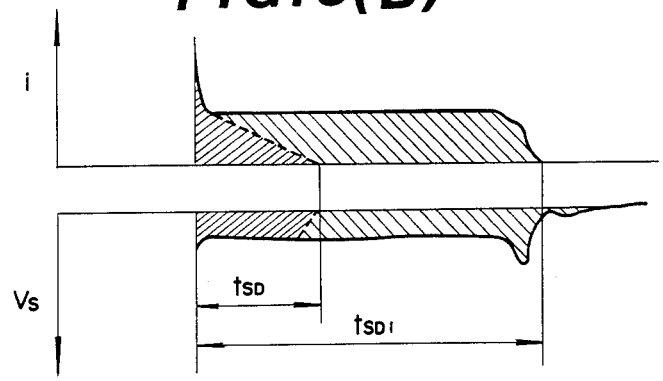
Figure 5C:
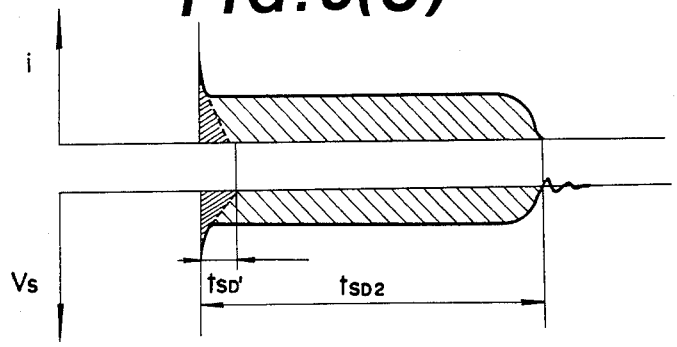

FIGS. 5(A), 5(B), and 5(C) show respective discharge patterns of the ignition system according to the present invention.

When the DC-DC converter 17 is inoperative, the discharge pattern is shown as FIG. 5(A) wherein a discharge duration is relatively short as denoted by $t_{SD}$. When the DC-DC converter 17 outputs the high DC voltage under such an engine operating condition as described above, the discharge duration is remarkably longer as denoted by $t_{SD1}$ shown in FIG. 5(B). Therefore, the ignition energy increases correspondingly so that stable combustion of fuel supplied within each engine cylinder can be made without misfire even when the engine revolves at a low speed or under a light engine load condition. Otherwise the ignition energy is saved (minimized) for efficient ignition of fuel as the discharge duration denoted by $t_{SD}$ indicates.

Figure 3A:
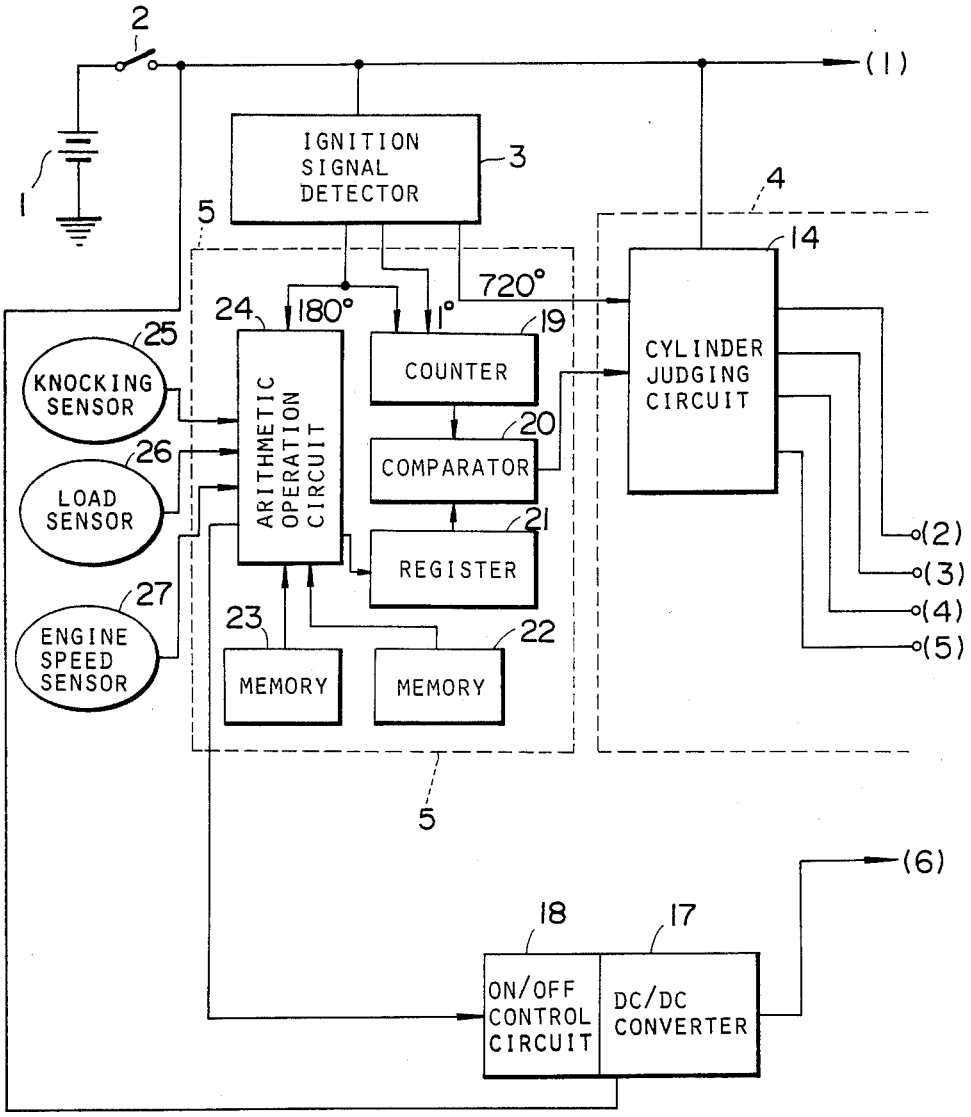
FIGS. 3(A) and 3(B) are simplified circuit diagrams of an ignition system for an internal combustion engine showing a second preferred embodiment according to the present invention.
Figure 3B:
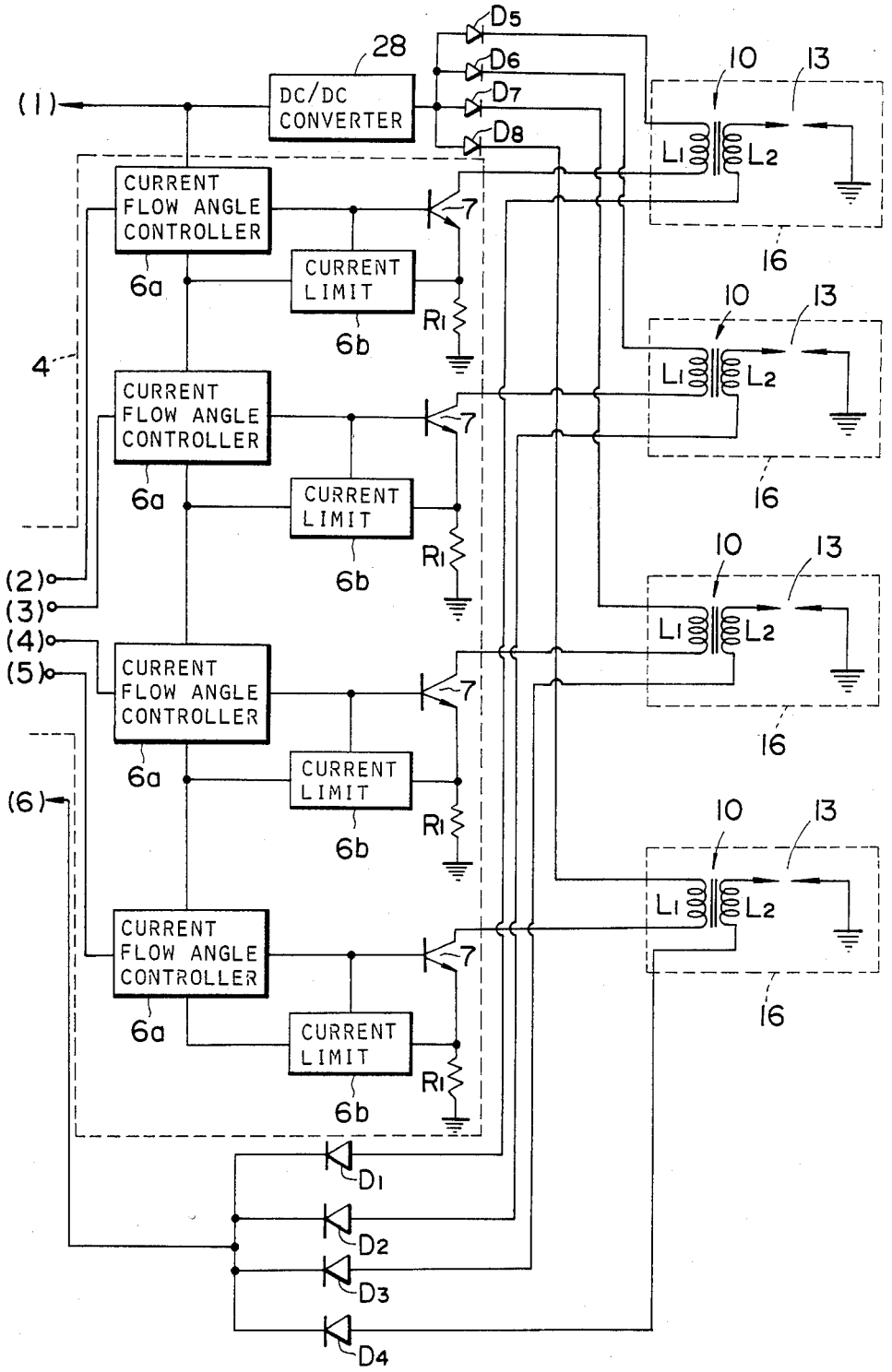

FIGS. 3(A) and 3(B) show a second preferred embodiment of the present invention. In this preferred embodiment, another DC-DC converter 28 is provided between the battery 1 and each one end of the primary winding $L_1$ of the ignition coil 10 via each of diodes $D_5$ through $D_8$. The DC-DC converter 28 outputs a relatively high DC voltage of about 100 through 300 volts into each primary winding $L_1$ of the ignition coil 10. Therefore, the primary bias voltage at each primary winding $L_1$ is considerably higher than in the case of the first preferred embodiment shown in FIGS. 2(A) and 2(B) so that the number of turns of both primary and secondary windings $L_1$ and $L_2$ of the individual ignition coils 10 are accordingly reduced. Consequently, the dimension of the individual assemblies 16 can be reduced. Since the other construction and operation are the same as those of the first preferred embodiment, the detailed description thereof is omitted hereinafter. The discharge pattern of one of the spark plugs 13 in the case of the second preferred embodiment is shown in FIG. 5(C).

When the DC-DC converter 17 is inoperative, the discharge duration is minimized as denoted by $t_{SD'}$ in FIG. 5(C) so that the ignition energy is accordingly minimized. When the discharge duration is minimized and ignition energy is accordingly reduced, the ignition of the supplied fuel can positively be carried out except under such low engine speed and light engine load conditions. On the other hand, when the DC-DC converter 17 outputs the high DC voltage in response to the start command signal from the arithmetic operation circuit 24, the discharge duration $t_{SD2}$ in FIG. 5(C) is remarkably longer in the same manner as shown by $t_{SD1}$ of FIG. 5(B).

Figure 4:
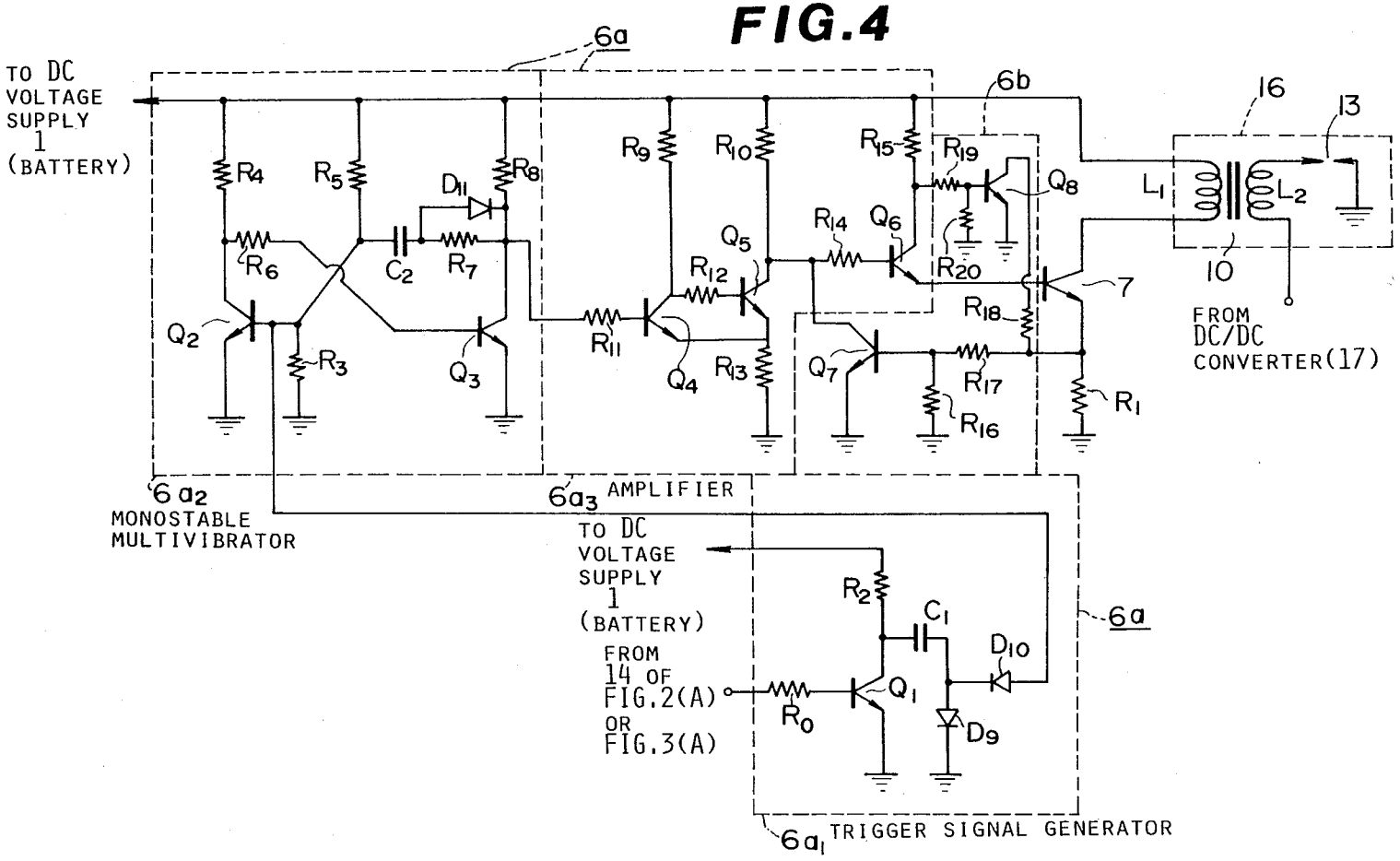
FIG. 4 is a circuit diagram showing an example of primary current angle controller and current limiting circuit 6*a* and 6*b* in FIGS. 2(B) and 3(B)

FIG. 4 shows an example of the current flow angle controller 6a and current limiting circuit 6b shown in FIG. 2(B) and FIG. 3(B). The resistor $R_1$ connected to an emitter of the power transistor 7 detects the magnitude of the primary current that flows through the primary winding $L_1$ of the corresponding ignition coil 10. When the primary current exceeds a predetermined limit value with the power transistor 7 turned on, the voltage across the resistor $R_1$ is accordingly increased so that a transistor $Q_7$ connected to the resistor $R_1$ turns on with its ON resistance reduced accordingly. At the same time, a collector-emitter voltage of a transistor $Q_8$ is accordingly increased. Therefore, a base current of the power transistor 7 is accordingly reduced so that the primary current is suppressed within the predetermined limit value. The primary current flow-angle controller 6a comprises: (a) a trigger signal generator $6a_1$ connected to the corresponding output terminal (2) through (5) of the cylinder judging circuit 14 shown in FIG. 2(A) or FIG. 3(A) for producing a negative-going trigger pulse in response to the ignition command pulse signal fed from the cylinder judging circuit 14; (b) a meta-stable state changeable monostable multivibrator $6a_2$ connected to the trigger signal generator $6a_1$ which changes the meta-stable state duration according to the engine speed; and (c) an amplifier $6a_3$ connected to the monostable multivibrator $6a_2$ which amplifies the output signal from the monostable multivibrator $6a_2$ and sends the amplified into the power transistor 7. When the monostable multivibrator $6a_2$ is at a stable state with no ignition start signal received at the trigger signal generator $6a_1$, a transistor $Q_2$ is turned on, transistor $Q_3$ is turned off, and power transistor 7 is, therefore, turned on. At this time, a capacitor $C_1$ charges from the DC voltage supply 1 shown in FIG. 2(A) or FIG. 3(A) with a transistor $Q_1$ turned off via resistor $R_2$ and diode $D_9$. Simultaneously, during the stable state, a capacitor $C_2$ charges at a time constant determined by resistance values of resistors $R_8$ and $R_7$ and capacitance value of the capacitor $C_2$ from the DC voltage supply 1 via the turned-on transistor $Q_2$. Next, when the ignition start signal from the cylinder judging circuit 14 is sent into the trigger signal generator $6a_1$, the transistor $Q_1$ is turned on so that the negative-going pulse is produced and outputted into the monostable multivibrator $6a_2$ via the diode $D_{10}$. Therefore, the transistor $Q_2$ is turned off and, in turn, the transistor $Q_3$ is turned on. Consequently, the power transistor 7 turns off to interrupt the current flow through the corresponding primary winding $L_1$. At this time, the charged voltage within the capacitor $C_2$ is discharged through a resistor $R_3$ with respect to the diode $D_{11}$ and turned-on transistor $Q_3$ since the monostable multivibrator $6a_2$ is at the meta-stable state. When the power transistor 7 turns off, the counter electromotive force is generated at the corresponding primary winding $L_1$ and the high surge voltage is produced at the secondary winding $L_s$ so as to generate a spark discharge at the corresponding spark plug 13. It should be noted that since the capacitor $C_2$ is connected in series with the resistors $R_7$ and $R_8$ to form the charge circuit during the stable state of the monostable circuit while the capacitor $C_2$ is connected in series with the resistor $R_3$ and diode $D_{11}$ to form the discharge circuit during the meta-stable state thereof, a large charge time constant is provided so that the duration of the meta-stable state becomes longer at a low engine speed range where the capacitor $C_2$ is sufficiently charged and becomes shorter at a high engine speed range where the capacitor $C_2$ is not sufficiently charged. Therefore, a time interval of interruption of the primary current is decreased as the engine speed increases.

As described hereinabove, the ignition system for a multi-cylinder internal combustion engine according to the present invention supplies the high DC voltage boosted by the DC-DC converter to the secondary winding of each ignition coil depending on the particular engine operating condition. Therefore, an ignition can efficiently be performed with a minimum ignition energy under a normal engine operating condition without misfire, the ignition energy being increased by means of the DC-DC converter exceptionally under an engine low-speed revolution such as during the engine start, idling and under a light load condition. In addition, since the ignition coil and spark plug are integrally assembled into each engine cylinder, the mechanical distributor, high-tension cables, and intermediate tap cord can be eliminated which provide sources of energy transmission loss. Consequently, a wasteful consumption of the ignition energy can be minimized, generation of electromagnetic noise can be prevented, and the danger of exposing the high voltage to a human body or other electrical circuitry can be avoided.

It should be appreciated that in the second preferred embodiment the ignition energy can be minimized as seen from FIG. 5(C) under the normal engine operating condition because of the continuous application of relatively high DC voltage to the primary windings of the individual ignition coils, so that the size of the individual ignition coil can be reduced and more efficient ignition can be achieved.

It will be understood by those skilled in the art that the foregoing description is in terms of preferred embodiments of the present invention wherein various changes and modifications can be made without departing from the spirit and scope of the invention, which is to be defined by the appended claims.

What is claimed is:

1. An ignition system for an internal combustion engine having a plurality of cylinders and a DC voltage source and at least one engine operating condition detector for generating a signal indicative of an engine operating condition, comprising:

(a) a spark plug for each of said cylinders, each of said spark plugs having a spark gap defined by a first electrode and a second grounded electrode;

(b) an ignition coil for each of said spark plugs, each of said ignition coils having a primary winding and secondary winding, one end of the secondary winding being directly connected to the first electrode of said spark plug and one end of said primary winding being biased by a DC voltage;

(c) an insulated housing for each of said ignition coils and corresponding spark plugs;

(d) a voltage boosting means connected to another end of the secondary windings of said ignition coils for applying a first boosted voltage to the spark gap of each of said spark plugs, said voltage boosting means including a control means responsive to an engine operating condition for selectively applying or interrupting said first boosted voltage;

(e) an ignition signal detector responsive to the rotation of said engine to generate a first signal having a period determined in accordance with the number of engine cylinders, and a second signal comprising a series of pulses having a pulse width which corresponds to an increment of engine rotation, and a third signal having a period which corresponds to one engine cycle;

(f) an ignition advance angle controller responsive to said ignition signal detector and said engine operating condition detector for determining an optimum spark timing angle relative to a top dead center position of a piston of each engine cylinder and for producing an ignition pulse signal whenever the number of pulses of the second signal reaches a predetermined optimum engine spark timing angle and for producing a control signal to said control means to enable said voltage boosting means to output said first boosted voltage to the secondary windings and thereby to the spark gaps in response to said engine operating condition; and (g) an igniting means responsive to said ignition advance angle controller and ignition signal detector for sequencially designating which of said plurality of engine cylinders to ignite according to a predetermined ignition order and for generating ignition start signals for selectively interrupting current flow through the primary winding of the ignition coil corresponding to said engine cylinder to be ignited in response to the ignition pulse signal from said ignition advance angle controller to thereby produce a high surge voltage at the corresponding secondary winding.

2. The ignition system of claim 1, further comprising an additional voltage boosting means having a second boosted output voltage connected to one end of each primary winding of said ignition coils for biasing said primary windings with said second boosted voltage whereby the number of turns of both said primary and secondary windings of said ignition coils can be reduced without reducing the voltage across the spark gaps.

3. The ignition system of claim 1, wherein said voltage boosting means comprises:

a DC-DC converter for receiving a low DC voltage from said DC voltage source and converting the low DC voltage into a corresonding AC voltage and for converting the AC voltage into said first boosted voltage which is applied to said spark plugs; and wherein said control means comprises an on/off control circuit responsive to said control signal from the ignition advance controller for controlling the application of the first boosted voltage from said DC-DC converter to said spark plugs.

4. The ignition system of claim 1, wherein said ignition advance angle controller comprises:

(a) an engine knocking detector, responsive to engine knocking to produce a knocking output signal;
(b) an engine load detector, responsive to a detected engine load to produce a load output signal;
(c) an engine speed detector, responsive to engine speed to produce a speed output signal;
(d) calculating means for calculating an optimum ignition advance angle, relative to the top dead center position, based on the output signals from said engine knocking, engine load, and engine speed detectors;
(e) a holding means for holding the calculated optimum ignition advance angle;
(f) a counting means for generating a count value corresponding to a number of pulses of said second signals, said counting means being reset whenever said first signal is generated; and
(g) a comparing means for comparing the optimum ignition advance angle in said holding means with the count value and for outputting an ignition pulse signal when the count value corresponds to the calculated ignition advance angle.

5. The ignition system of claim 2, wherein said additional voltage boosting means comprises a second DC-DC converter for receiving the low DC voltage from said low DC voltage source and for converting the low DC voltage into a corresponding AC voltage and for converting the AC voltage into said second boosted voltage which is applied to said primary windings of said ignition coils.

6. The ignition system of claim 1, wherein said increment of engine rotation comprises one degree of engine rotation.

7. The ignition system of claim 1, further comprising a current flow angle controller for each of said ignition coils, said current flow angle controllers being responsive to said ignition start signals to time the start of primary current flow interruption and to engine speed for controlling a time duration of primary current flow interruption.

8. The ignition system of claim 7, further comprising a current limiter for limiting the magnitude of said primary current below a predetermined value.

* * * * *